United States Patent [19]

Vagias

[11] 4,096,779

[45] Jun. 27, 1978

[54] STRING ANCHOR REPLACEMENT FOR REPETITION LEVER AND JACK IN A PIANO ACTION

[76] Inventor: Ernest Vagias, 265 Prospect St., Baden, Pa. 15005

[21] Appl. No.: 757,764

[22] Filed: Jan. 7, 1977

[51] Int. Cl.[2] ..... G10C 3/22

[52] U.S. Cl. ..... 84/239; 84/243

[58] Field of Search ..... 84/236–243, 84/247–249

[56] References Cited

U.S. PATENT DOCUMENTS

| | | | |
|---|---|---|---|
| 436,511 | 9/1890 | Wessell | 84/239 X |
| 954,140 | 4/1910 | Schnabel | 84/239 |
| 1,436,303 | 11/1922 | Ahlstrom | 84/239 |
| 1,663,538 | 3/1928 | Chute | 84/243 |
| 2,021,449 | 11/1935 | George | 84/239 |
| 2,466,498 | 4/1949 | Smith | 84/239 |

*Primary Examiner*—Lawrence R. Franklin
*Attorney, Agent, or Firm*—Thomas H. Murray

[57] ABSTRACT

Rectangularly-shaped wooden anchors are adhered by glue onto face surfaces of a wippen and a jack in a piano action. Each has a central annular opening through which a looped portion of a string extends for connection to a spring used to impose a spring force upon a repetition lever and upon a jack. Each anchor, made of wood, has a thickness of 0.12 inch or less and includes a slot extending to an edge to adjustably receive one terminal end of the string to provide the desired length to the loop in the string.

9 Claims, 3 Drawing Figures

STRING ANCHOR REPLACEMENT FOR REPETITION LEVER AND JACK IN A PIANO ACTION

BACKGROUND OF THE INVENTION

This invention relates to a string anchor apparatus for replacing broken strings in piano actions which are employed to couple a spring associated with the repetition lever to a wippen and to couple a spring to a jack. More particularly, the present invention relates to such an apparatus to facilitate repairs to such a piano action in a rapid and efficient manner.

Grand actions for pianos employ a looped portion in a string to couple, in one aspect, a spring associated with the repetition lever to a support or wippen while in another aspect a similar but shorter looped portion of a string is used to couple a spring to the jack. When these strings break, a regulating button at one end of the repetition lever is no longer urged into contact with the wippen while the jack, when the string associated therewith breaks, is no longer urged at its upper end into engagement, along a slot, with the repetition lever. It is a laborious and time-consuming task to replace the strings in such a grand piano action because wooden plugs are used to fasten the free ends of the strings within a drilled opening in the wippen and/or jack. Therefore, to replace a string, it is necessary that the piano action be removed and then the wooden plug removed, destructively, by a drill so that a replacement string can be held in place through the use of a replacement plug. Not only does the replacement operation consume a considerable amount of time, but also the length of the looped portion of the string must be relatively accurate so that the proper spring tension force is applied to the associated lever. While some adjustment to the spring force is possible by adjusting the spring force or by other measures, it is nevertheless mandatory that the length of the looped portion of the string lie within a narrow tolerance. Thus, it is a critical operation not only to remove the support plug for the string but also to support the replacement string by a new plug to insure that the desired length to the looped portion of the string remains after the replacement operation is completed. The length of the looped portion of the string is relatively small whereby slight adjustments to the length are usually difficult to accomplish.

SUMMARY OF THE INVENTION

It is an object of the present invention to provide a string anchor assembly embodying an improved construction and relationship of parts for attachment of such an assembly onto a repetition lever and/or onto a jack in a piano action whereby a looped portion of the anchored string is readily accessible for connection to the free end of a spring employed to bias with a resilient force, certain parts of the piano action.

It is a further object of the present invention to provide a string anchor assembly in the form of a relatively thin block of wood having a centrally-arranged opening through which a looped portion of a string extends while the ends of the string are secured either to the block of wood or between the block of wood and a support surface in the piano action by adhesive.

It is still a further object of the present invention to provide a string anchor assembly to facilitate the replacement of broken strings used to interconnect a wippen with a repetition lever and/or a jack with the wippen via a support pedestal in a piano action.

More specifically, the present invention provides in a piano action of the type including a wippen having a support pedestal joined at its upper end by a pivot pin to a repetition lever, a jack pivotally connected at one end to the wippen to extend into an opening in an end of the repetition lever, a spring to urge a regulation button, at the end of the repetition lever which is opposite the jack, toward a face surface of the wippen, the repetition lever having an opening therein underlying an end of the spring and overlying the face surface of the wippen, the improvement comprising, in combination, an anchor plate adhered onto the face surface of the wippen between the support pedestal and the contact area by the regulation button, the anchor plate having a string opening in a generally underlying location beneath the opening in the repetition lever, and a string anchored at its two ends by the anchor plate while a looped portion extends through the string opening in the anchor plate, the looped portion of the string having a sufficient length to extend through the opening in the repetition lever for connection with the spring.

In still another aspect of the present invention, there is provided in a piano action of the type including a wippen having a support pedestal joined at its upper end by a pivot pin to a repetition lever, a jack pivotally connected at one end to the wippen to extend into an opening within an end of the repetition lever, a spring to urge a regulation button supported by the jack toward a stop surface supported by the wippen, the improvement comprising, in combination, an anchor plate adhered onto the face surface of the jack which surface is directed toward the support pedestal between the wippen and the repetition lever, the anchor plate having a string opening facing toward the support pedestal and a string anchored at its two ends by the anchor plate while a looped portion thereof extends through the string opening in the anchor plate, the looped portion of the string having a sufficient length to engage the spring to urge the jack about its pivotal connection toward the support pedestal.

In both of the aforesaid aspects of the present invention, the anchor plate preferably includes a slot opening out of one edge thereof to receive a terminal end portion of the string for adjusting the length of the looped portion of the string before the anchor plate is adhesively secured onto a support surface in a piano action. The width of the anchor plate essentially corresponds to the width of the support surface onto which it is to be adhesively secured. The anchor plate may be constructed from wood or the like with a thickness of 0.12 inch or less.

These features and advantages of the present invention as well as others will be more fully understood when the following description is read in light of the accompanying drawings, in which.

Figure 1:
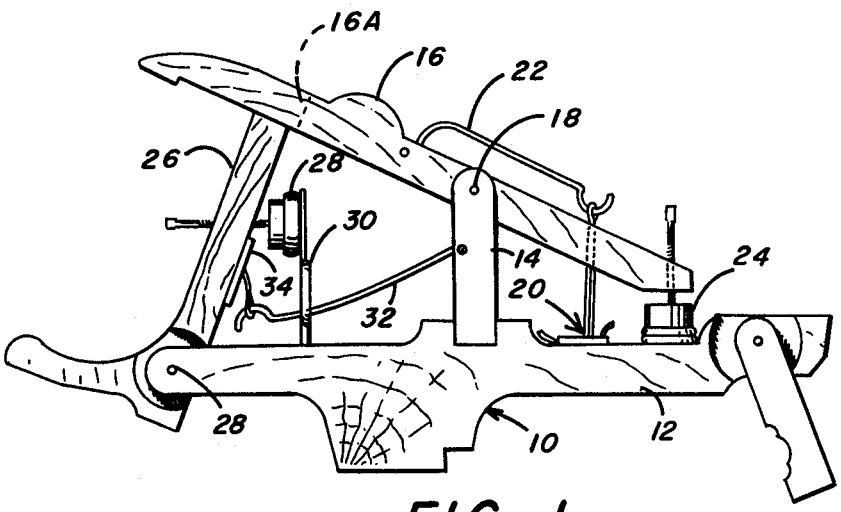
FIG. 1 is an elevational view of a piano action incorporating anchor assemblies according to the present invention.
Figure 2:
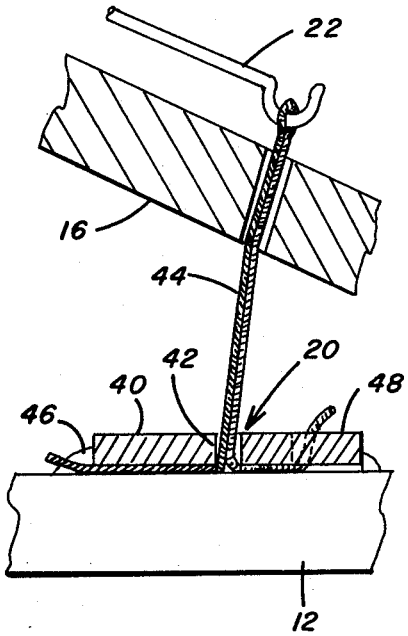
FIG. 2 is an enlarged partial view of the anchor assembly to provide a looped end of the string for a repetition lever.

In FIG. 1, there is illustrated a piano action 10 including a wippen 12. A wippen of the type shown in the drawings is usually about 4½ inches long and ⅜ inch wide. The wippen is made from wood and supports at its mid-portion a pedestal 14 extending at right angles to the extended length of the wippen. The upper end of the pedestal has a slotted end into which a repetition lever 16 is received and connected thereto by a pivot pin 18. An anchor assembly 20 embodying the features of the present invention is employed to provide a stringed interconnection between the wippen through an opening, as seen in FIG. 2, in the repetition lever and the end of a spring 22 which is supported by the repetition lever. The opening overlies the support site on the wippen for the anchor assembly 20. A regulation button 24 is connected by a screw shaft at the end of the repetition lever which is opposite a lever which is referred to in the art as a jack and identified in FIGS. 1 and 2 by reference numeral 26. The jack 26 is secured by a pivot pin 28 to the wippen 12 with the projected end of the jack extending into a slotted opening 16A in the repetition lever. A regulation button 28 is secured by a threaded shaft to the jack. The button engages an upstanding plate 30 which forms a stop member supported by the wippen. A spring 32 secured at one end to the pedestal 14 has its free end connected to a string anchor assembly 34 which embodies the features of the present invention.

As shown in FIG. 2, the string anchor assembly 20 includes a rectangular block 40 which is made of any suitable material, preferably wood. The anchor plate 40 typically has a width of about ⅜ inch which corresponds to the width of the wippen 12 at the support site therefor. The thickness of the anchor plate is typically 0.12 inch or less. When the anchor plate is made of wood, the grain thereof should extend parallel to the elongated direction of the wippen. The anchor plate includes a centrally-arranged opening 42 out of which extends the looped end 44 of a string. This string is preferably made from silk but a string made from cotton or wool is also suitable. The looped end of the string, as shown in FIG. 2, is engaged with the free end of spring 22. The free ends of the string extend along the bottom surface of the string anchor where a layer of adhesive secures the string to the anchor plate and the wippen. The adhesive should be rapidly-setting material which is compatible with the material of the string and provides an adhesive strength for long continued integrity of the adhesive attachment. One free end of the string extends upwardly through a slotted opening 48 which is elongated so as to open out of an end surface of the anchor plate thereby facilitating the engagement of the string and the slot.

Figure 3:
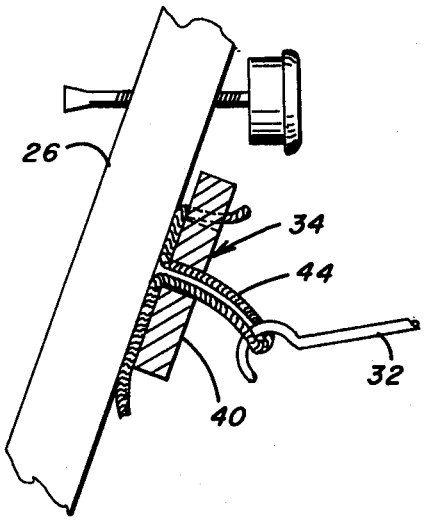
FIG. 3 is an enlarged view of an anchor assembly employed to provide a looped end of the string for a jack.

The string anchor assembly 34, shown in FIGS. 1 and 3, embodies essentially the same construction and arrangement of parts as just described in regard to the anchor plate assembly 20. However, it is to be understood that depending on the particular construction of the piano action, the length of the looped portion of the string 44 will be determined preferably before adhesive contact with the jack so as to provide the desired interconnection between the spring 32 and the jack 26. The anchor plate 40 of the string anchor assembly 34 is identical with that employed in the anchor assembly 20.

As described hereinbefore, the string anchor assembly of the present invention eliminates the laborious and time-consuming task of removing, by drilling, the wooden plug used to secure a string to the wippen and/or jack. This becomes highly significant in terms of replacing the two strings for the piano action of each the 88 keys in a piano. Moreover, through the use of the string anchor assembly of the present invention, it is no longer necessary to remove the entire action from the piano to a repair shop since on-site replacement of all the strings in the piano action of a piano can be replaced in about 30–45 minutes whereas normally such an undertaking required at least 8–10 hours, if not longer.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a piano action of the type including a wippen having a support pedestal extending from the upper surface of said wippen, a repetition lever pivotally connected to said support pedestal, a jack pivotally connected at one end of the wippen to extend into an opening in an end of the repetition lever, a spring having one end connected to said repetition lever and a free end overlying a second opening through said repetition lever to urge a regulation button mounted at the end of the repetition lever which is opposite the jack toward a contact area on said upper surface of said wippen, the improvement comprising, in combination, an anchor plate adhered onto the upper surface of said wippen between said support pedestal and the contact area, said anchor plate having a string opening therethrough at a generally underlying location beneath said second opening in the repetition lever, and a string having end portions anchored between said wippen and said anchor plate while (a) an intermediate looped portion extends through the string opening in said anchor plate, the looped portion of the string having a sufficient length to extend through said second opening in the repetition lever for connection with said spring.

2. The improvement according to claim 1 wherein said anchor plate includes a slot opening out of one edge thereof to receive a terminal end portion of said string for adjusting the length of the looped portion of the string.

3. The improvement according to claim 1 wherein said anchor plate has a width essentially corresponding to the width of said wippen at the support site.

4. The improvement according to claim 1 wherein said anchor plate is made from wood having a thickness of 0.12 inch or less.

5. The improvement according to claim 1 further comprising a jack anchor plate adhered onto the surface of said jack which faces said support pedestal, said jack anchor plate having a string opening therethrough directed toward said pedestal, spring means to bias said jack toward said support pedestal, and a string having end portions anchored between said jack and said jack anchor plate while an intermediate looped portion extends through said string opening therein, the looped portion of the string having a sufficient length for connection with said spring to bias the jack.

6. In a piano action of the type including a wippen having a support pedestal extending from said wippen, a repetition lever pivotally connected to said support pedestal, a jack pivotally connected at one end of the wippen to extend into an opening within an end of the repetition lever, a spring to urge a regulation button supported by the jack toward a stop surface supported by the wippen, the improvement comprising, in combination, an anchor plate adhered onto the surface of said jack which faces said support pedestal between said wippen and said repetition lever, said anchor plate having a string opening therethrough facing toward said support pedestal, and a string having end portions anchored between said jack and said anchor plate while an intermediate looped portion thereof extends through the string opening in said anchor plate, the looped portion of the string having a sufficient length to engage said spring to urge said jack about its pivotal connection toward said support pedestal.

7. The improvement according to claim 6 wherein said anchor plate includes a plate opening out of one edge thereof to receive a terminal end portion of said string for adjusting the length of the looped portion of the string.

8. The improvement according to claim 6 wherein said anchor plate has a width essentially corresponding to the width of said wippen at the support site.

9. The improvement according to claim 6 wherein said anchor plate is made of wood having a thickness of 0.12 inch or less.

* * * * *